US005348099A

United States Patent [19]

Yokoi

[11] Patent Number: 5,348,099

[45] Date of Patent: Sep. 20, 1994

[54] INDOOR FIRE HYDRANT APPARATUS

[75] Inventor: Shin Yokoi, Osaka, Japan

[73] Assignee: Yokoi Manufacturing Co., Ltd., Osaka, Japan

[21] Appl. No.: 21,459

[22] Filed: Feb. 23, 1993

[30] Foreign Application Priority Data

Nov. 2, 1992 [JP] Japan ..... 4-75720

[51] Int. Cl.[5] ..... A62C 35/20

[52] U.S. Cl. ..... 169/51; 174/47

[58] Field of Search ..... 169/51, 61, 70; 138/103, 104, 108; 174/47; 439/191

[56] References Cited

U.S. PATENT DOCUMENTS 5,109,534 4/1992 Naito et al. ..... 174/47 X

*Primary Examiner*—David M. Mitchell
*Assistant Examiner*—Andrew C. Pike
*Attorney, Agent, or Firm*—Griffin Butler Whisenhunt & Kurtossy

[57] ABSTRACT

An indoor fire hydrant apparatus includes a fire hose having electrical conductors extending along its length and connected to a switch mounted near the nozzle end of the hose. Closure of the switch causes energization of a solenoid-actuated valve which is connected between a source of water under pressure and the hose. Closure of the switch also causes energization of a pump to build up the water pressure. A single person may pull the hose from a rack, extend it toward a fire, and actuate the switch thereby causing water under pressure to be dispersed through the nozzle. The electrical conductors may be embedded in a wall of the fire hose or mounted on an exterior surface of the hose. The hose may be of the folding type or the type which maintains its generally circular shape.

1 Claim, 4 Drawing Sheets

INDOOR FIRE HYDRANT APPARATUS

FIELD OF THE INVENTION

The present invention relates to an indoor fire hydrant apparatus of the type found in office buildings, warehouses, hotels, and the like, and more particularly to an improved fire hydrant apparatus which permits a user to position a hose for fire fighting and then subsequently control the application of water under pressure to the hose, the control being accomplished from the nozzle end of the hose,

BACKGROUND OF THE INVENTION

In an indoor fire hydrant apparatus of the prior art, a hose is hung on a hanger and a switch for starting a pump is positioned near the hanger and hose. When the switch is actuated, water at a relatively high pressure is pumped into the hose through a discharge valve. This system requires two persons in order for the hose to he put in a fire-fighting position at the earliest possible moment. One person removes the hose from the hanger and deploys the nozzle end of the hose in the fire-fighting position. After this is accomplished, the second person actuates the switch to start the pump and manually opens the discharge valve whereby water is pumped into the hose.

If the person opening the discharge valve should do so before the other person has fully deployed the hose, the water applied under pressure causes the hose to fill out and jump because of folds in the hose. This makes it difficult to deploy the hose and increases the deployment time thus delaying application of water to the fire.

A single person attempting to use the apparatus is faced with a problem. If he actuates the pump switch and opens the discharge valve before he fully deploys the hose, the pressurized water makes it difficult to handle the hose, thus increasing the time required to get the hose into a fire-fighting position. On the other hand, if he first deploys the hose then he must lay down the nozzle end of the hose and go back to actuate the switch and open the discharge valve. He must then return to the nozzle end of the hose to begin the fire-fighting activity.

SUMMARY OF THE INVENTION

An object of the present invention is to provide an indoor fire hydrant apparatus which permits a single person to easily begin a fire-fighting activity with a minimum delay.

Another object of the present invention is to provide an indoor fire hydrant apparatus which permits a single person to deploy a hose and then control the flow of water under pressure into the hose, the control being accomplished from the nozzle end of the hose so that he need not return to the discharge valve.

A further object of the invention is to provide an indoor fire hydrant apparatus which prevents the application of water to a hose until the person handling the hose is ready to apply water from the hose to a fire.

In accordance with the principles of the present invention, a solenoid actuated discharge valve, a relay, and a pump start switch are disposed near a support which supports a fire hose. The fire hose is provided with two electrical conductors extending along its length and a discharge control switch is located near the nozzle end of the hose. A user deploys the hose and then actuates the discharge control switch to thereby energize the relay and the solenoid of the discharge valve. The relay has contacts connected in parallel with the pump start switch so the pump is started when the relay is energized. The energized solenoid opens the discharge valve so that the pumped water is applied to the hose.

Other objects of the invention and its mode of operation will become apparent upon consideration of the following description and the accompanying drawings.

DETAILED DESCRIPTION

Figure 1:
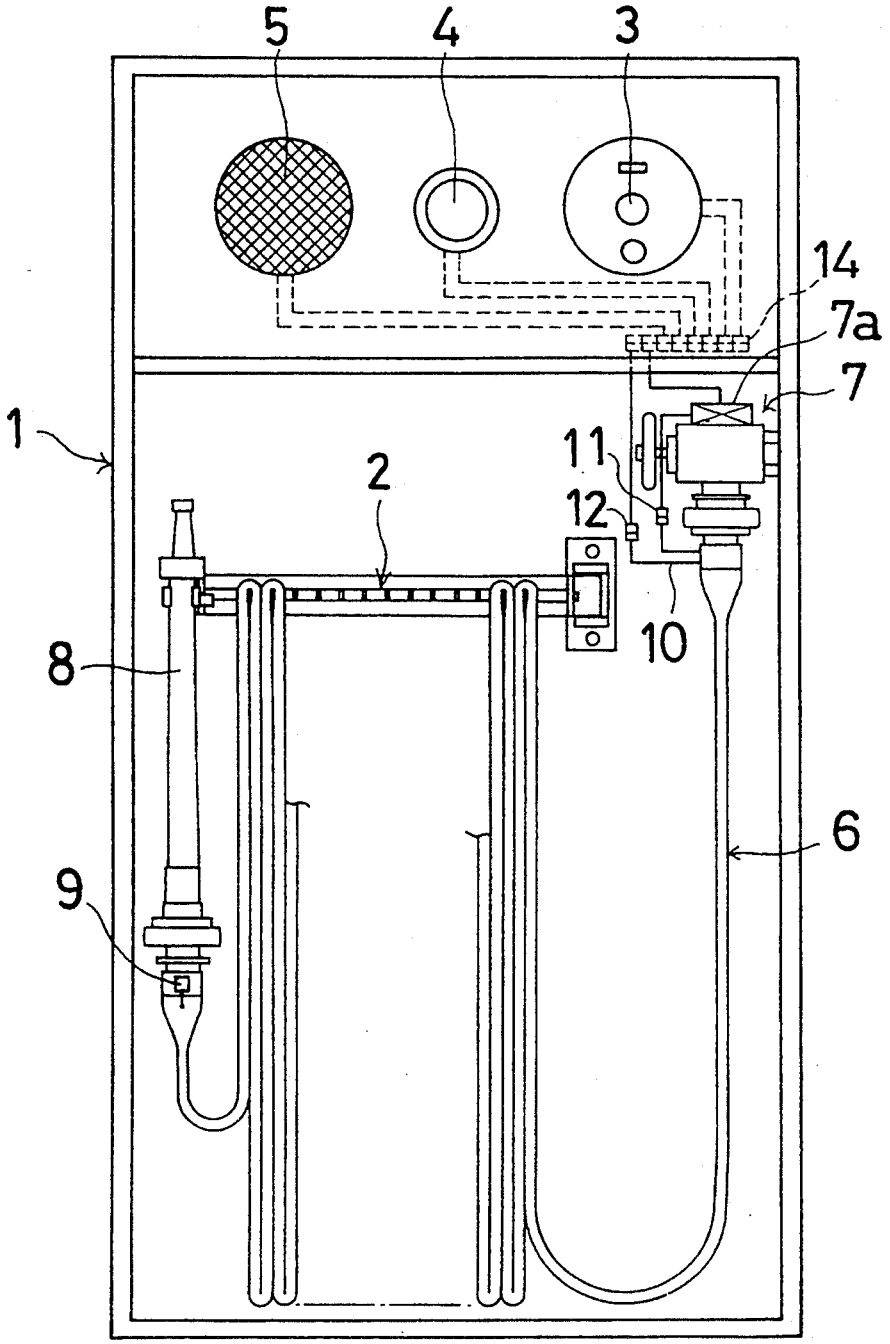
FIG. 1 is a front view of a first embodiment of a fire hydrant apparatus, the apparatus including a folding type fire hose.

As illustrated in FIG. 1, a first embodiment of an indoor fire hydrant apparatus comprises a fire hydrant box 1, a fire hose 6, a hose hanger 2 mounted within the box 1 for supporting the hose in a folded condition, a pump-start pushbutton switch 3, an indicator light 4, and an alarm bell 5.

Figure 2:
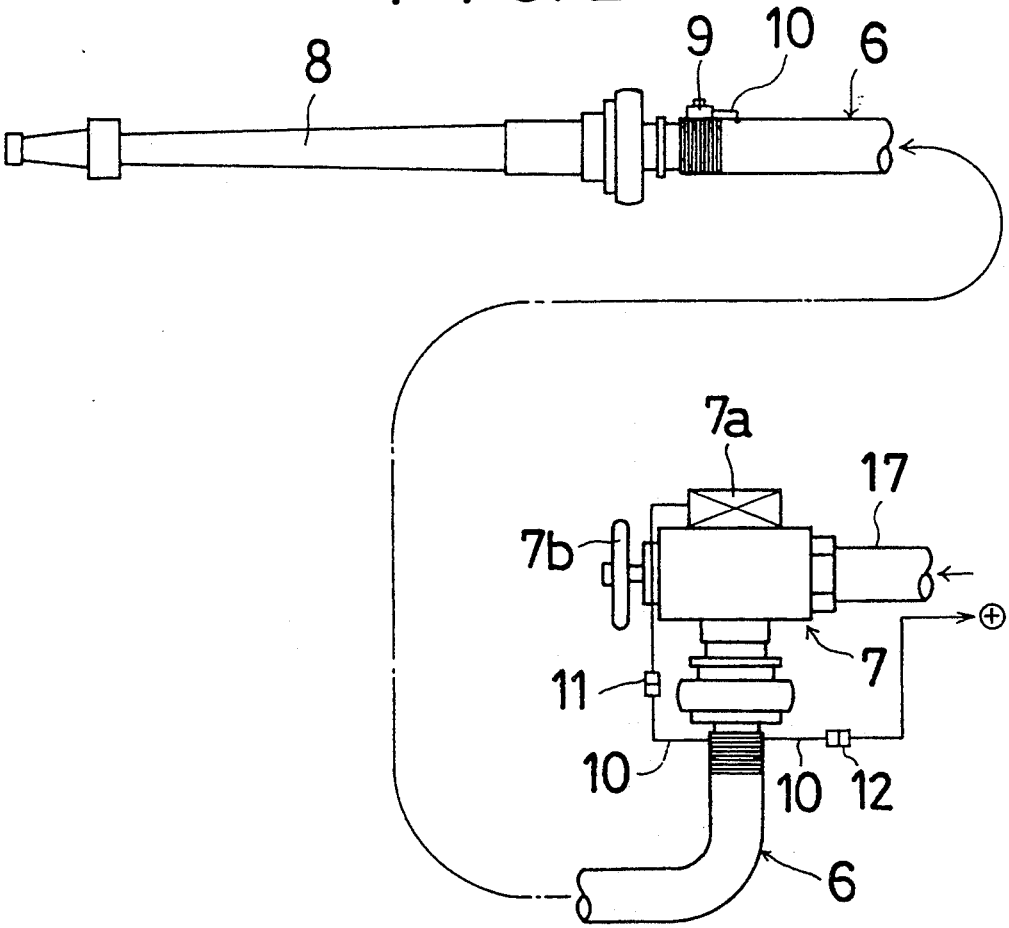
FIG. 2 shows the hose, nozzle, and solenoid actuated discharge valve.
Figure 3:
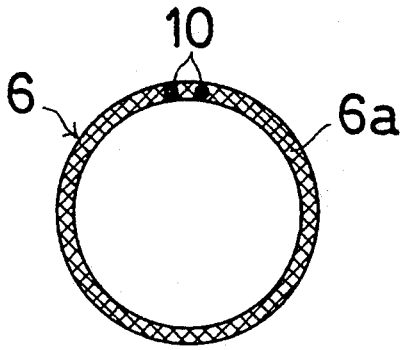
FIG. 3 shows a hose having conductors embedded in the hose wall.

The hose 6 is of the folding type and is composed of rubberized or rubber-coated canvas as is conventional in the art, but in addition has two electrical leads or conductors 10 extending along its length. At one end, the conductors 10 are connected through connectors 11 and 12, respectively, to a voltage supply and one side of a solenoid *7a*, respectively, as illustrated in FIG. 2. The other end of each conductor 10 is connected to one side of a water-proof manually actuated on/off discharge control switch 9. The conductors 10 may be embedded in the wall *6a* of the hose, as illustrated in FIG. 3, or they may be affixed to the outer surface of the wall.

The hose 6 is provided with appropriate fittings for connecting the hose to a discharge nozzle 8 at one end and to the discharge port of a discharge control valve 7 at the other end. The switch 9 is located near the end of hose 6 close to nozzle 8 so that a user may operate the switch while aiming the nozzle in the direction in which he desires to direct water. Switch 9 is a waterproof switch of the on/off type. That is, it need not be held in order to keep the circuit closed. The switch 9 may be mounted on the hose 6, the discharge nozzle 8, or the fitting connecting the hose to the nozzle.

Discharge control valve 7 is a pilot valve which is actuated by energizing solenoid *7a* to thereby permit water to flow from a water supply pipe 17 (FIG. 2) through the valve, to the hose 6. A manually operated handle or hand wheel *7b* is provided so that valve 7 may be manually opened in the event of a power failure or other condition which prevents energization of solenoid *7a*.

Figure 4:
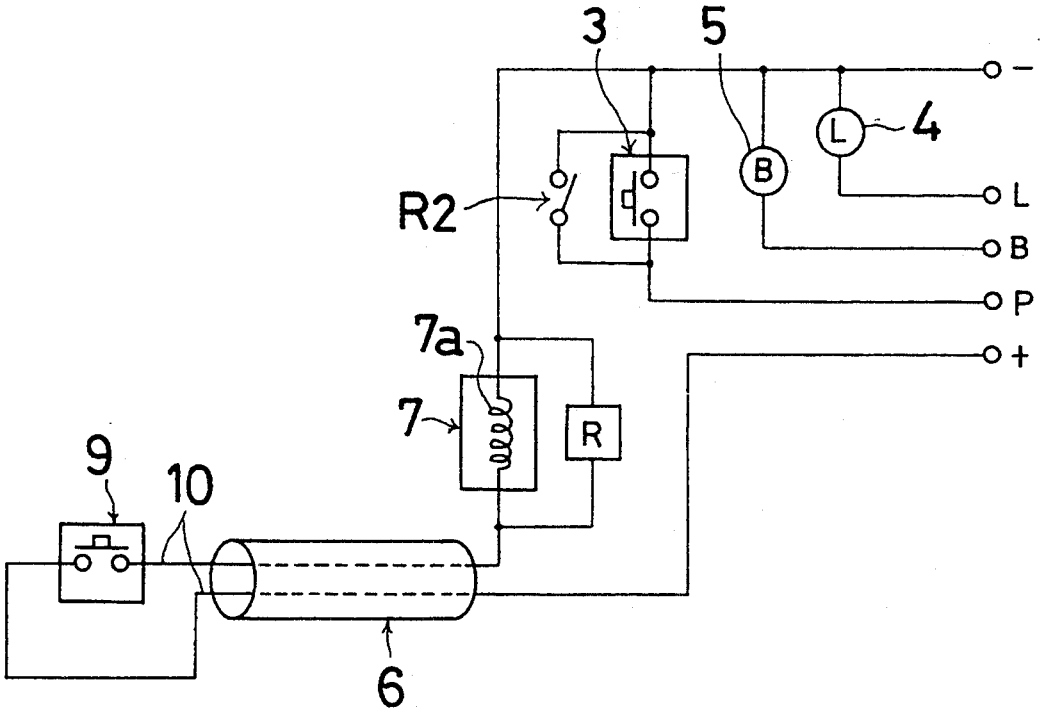
FIG. 4 is a diagram illustrating a first embodiment of a circuit for controlling the discharge control valve.

FIG. 4 illustrates a suitable circuit for controlling energization of the solenoid 7*a*. A terminal block 14 (FIG. 1) is provided with terminals designated −, L, B, P, and +. Terminals L and B are connected to conventional circuits (not shown) for energizing the lamp 4 and bell 5. The + and − terminals are connected to the positive and negative sides of a power supply. The P terminal is connected to a circuit which energizes a pump (not shown) located in the water supply pipe 17. This pump delivers water under high pressure to the pipe 17.

Within the box 1, the + terminal of terminal block 14 is connected by one of conductors 10 to one terminal of the switch 9. The other terminal of switch 9 is connected by the second conductor 10 to one side of the solenoid 7*a* of valve 7 and a relay R. The − terminal of terminal block 14 is connected to the other side of solenoid 7*a* and relay R. The pump starting switch 3 is connected between terminal P and the − terminal and a set of normally open relay contacts R2, operated by relay R, is connected in parallel with switch 3.

In the event of a fire, a person desiring to use the apparatus opens a front cover (not shown) of box 1 and actuates switch 3 to start the pump, thus building up water pressure in pipe 17. The user then removes nozzle 8 and hose 6 from hanger 2 and pulls the hose toward the fire. Nozzle 8 is directed toward the fire and switch 9 is actuated. This completes a circuit from the + terminal through switch 9, conductors 10, and solenoid 7*a*, thus opening valve 7 so that water may flow from pipe 17 through valve 7, hose 6, and nozzle 8.

Relay R is energized at the same time solenoid 7*a* is energized. The relay contacts R2 close thereby completing a circuit around the pump starting switch 3. Thus, the pump is started when switch 9 is actuated if the user forgets to operate switch 3 before he extends the hose.

Figure 5:
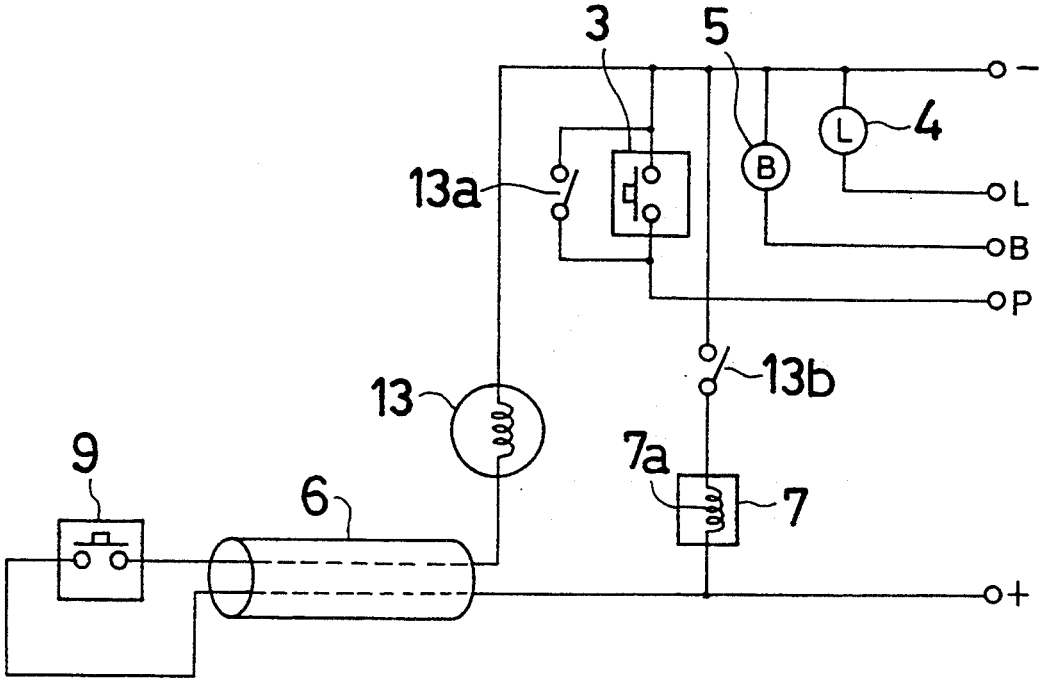
FIG. 5 is a diagram illustrating a second embodiment of a circuit for controlling the discharge control valve; and, FIG. 6 is a front view of a second embodiment of a fire hydrant apparatus, the apparatus including a fire hose of the type which retains a generally circular shape.

FIG. 5 illustrates a second embodiment of the control circuit wherein a relay 13 is connected in series with the switch 9 and conductors 10. The relay is provided with two sets of contacts 13*a* and 13*b*. The solenoid 7*a* of valve 7 is connected in series with contacts 13*b* across the + and − terminals. Contacts 13*a* are connected in parallel with switch 3.

In the embodiment of FIG. 5, relay 13 is energized when switch 9 is closed. The relay closes contacts 13*b* thus completing the circuit for energizing solenoid 7*a* so that valve 7 is opened and water from pipe 17 flows into the hose. The relay closes contacts 13*a* so that the pump is started if the user has not previously actuated pump start switch 3.

Figure 6:
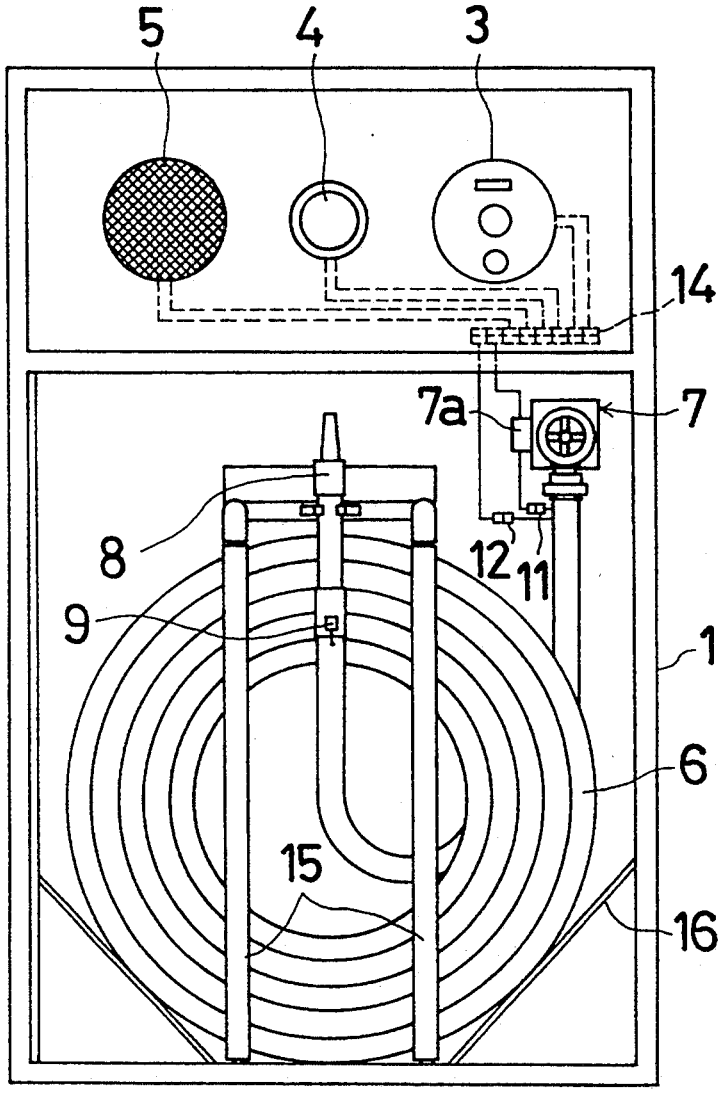

In FIG. 1, the hose is of the type which collapses and may be folded. FIG. 6 illustrates an arrangement where the hose is made of a material such that the hose retains a generally circular cross-sectional shape. Instead of a hose hanger 2, the box 1 is provided with hose support plates 16 and the hose is coiled in the box 1 behind retainer rollers 15.

While preferred embodiments of the invention have been described in detail by way of illustration, various modifications and substitutions falling within the spirit and scope of the invention will be obvious to those skilled in the art, and others. It is intended therefor to be limited only by the scope of the appended claims.

I claim:

1. An indoor fire hydrant apparatus comprising:

a fire hose with a discharge nozzle connected to a first end thereof;

an electrically operated discharge valve having an input port connected to a source of water under pressure and an output port connected to a second end of said first hose;

a discharge control switch located near said first end of said fire hose;

a relay having a first set of contacts connected in a series circuit with said electrically operated discharge valve across a supply voltage;

first and second electrical conductors extending along said fire hose, said conductors, said relay, and said discharge control switch being connected in a series circuit across said supply voltage whereby actuation of said discharge control switch causes energization of said relay and, in turn, energization of said discharge control valve to thereby permit water under pressure to flow into said fire hose, and a pump start switch and a second set of relay contacts connected in parallel with said pump start switch, said second set of relay contacts being controlled by said relay.

* * * * *